US008569628B2

(12) United States Patent
Abe et al.

(10) Patent No.: US 8,569,628 B2
(45) Date of Patent: Oct. 29, 2013

(54) INSULATED WIRE

(75) Inventors: Tomiya Abe, Hitachi (JP); Takanori Yamazaki, Mito (JP); Kiyoshi Watanabe, Hitachi (JP); Hideyuki Kikuchi, Hitachi (JP); Takahiko Hanada, Hitachi (JP); Daisuke Hino, Hitachi (JP)

(73) Assignees: Hitachi Cable, Ltd., Tokyo (JP); Hitachi Magnet Wire Corp., Ibaraki (JP)

( * ) Notice: Subject to any disclaimer, the term of this patent is extended or adjusted under 35 U.S.C. 154(b) by 235 days.

(21) Appl. No.: 12/870,329

(22) Filed: Aug. 27, 2010

(65) Prior Publication Data

US 2011/0192632 A1 Aug. 11, 2011

(30) Foreign Application Priority Data

Feb. 10, 2010 (JP) ..... 2010-027204

(51) Int. Cl.
*H01B 7/00* (2006.01)

(52) U.S. Cl.
USPC ..... 174/120 R

(58) Field of Classification Search
USPC ..... 174/120 R, 120 SR
See application file for complete search history.

(56) References Cited

U.S. PATENT DOCUMENTS

| | | | | |
|---|---|---|---|---|
| 5,358,786 | A * | 10/1994 | Ishikawa et al. | 428/380 |
| 7,915,532 | B2 * | 3/2011 | Varkey et al. | 174/110 R |
| 2008/0102285 | A1 * | 5/2008 | Aida et al. | 428/421 |

FOREIGN PATENT DOCUMENTS

| | | |
|---|---|---|
| JP | 2005-203334 | 7/2005 |
| JP | 2008-288106 | 11/2008 |

* cited by examiner

*Primary Examiner* — Chau Nguyen
(74) *Attorney, Agent, or Firm* — Antonelli, Terry, Stout & Kraus, LLP.

(57) ABSTRACT

There is provided an insulated wire having an insulation film composed of a plurality of layers provided on a conductor, in which: the insulation film includes a first film layer and a second film layer; the first film layer is made of a first resin composition formed by graft-polymerizing a graft compound with an ethylene-tetrafluoroethylene copolymer and is provided on a circumference of the conductor; and the second film layer is made of a second resin composition being a polymer alloy made of a polyphenylene sulfide resin and a polyamide resin, or being a polymer alloy made of a polyether ether ketone resin and a polyamide resin and is provided on a circumference of the first film layer.

8 Claims, 1 Drawing Sheet

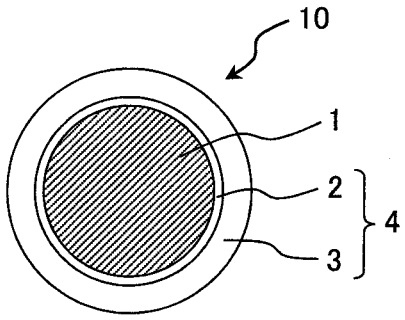
10
1
2
4
3

INSULATED WIRE

CLAIM OF PRIORITY

The present application claims priority from Japanese patent application serial no. 2010-027204 filed on Feb. 10, 2010, the content of which is hereby incorporated by reference into this application.

BACKGROUND OF THE INVENTION

1. Field of the Invention

The present invention relates to an insulated wire having an insulation film formed by applying an insulation film paint on a surface of a conductor and baking it. Particularly, the invention relates to an insulated wire used as coil windings for electrical equipment such as motors.

2. Description of the Related Art

Generally, an insulated wire used for coils for electrical equipment, such as motors and transformers, is constructed such that a single layer or a plurality of layers of insulation film made by applying and baking an insulation film paint is formed on a conductor molded so as to have a cross-sectional shape (e.g. round or rectangle) to conform to the usage and shape of the coil. Due to the recent requirements for smaller size, higher performance, and energy conservation of electrical equipment, the application of inverter control for electrical equipment, such as motors and transformers, is becoming more and more popular. Also, to meet the demand, higher voltages and larger currents (greater electric power) are being used for the inverter control.

In the inverter control, a steep overvoltage (inverter surge voltage) can possibly occur, and there is concern that the increasing use of higher voltages as well as the inverter surge voltage may adversely affect the insulation system of the coil in electrical equipment. Specifically, electric fields concentrate in the small gaps among insulated wires constituting a coil, which may result in the occurrence of partial-discharge between adjacent insulated wires (between film and film) or between the insulated wire and the ground (between film and coil core). Partial discharge may cause corrosion deterioration (partial-discharge deterioration) of the insulation film, and with the progress of the partial-discharge deterioration, dielectric breakdown of the coil may occur.

To prevent deterioration due to partial discharge, it is desirable to suppress the generation of partial discharge between the insulation films, that is, it is desirable to make the partial-discharge start voltage in the insulation film high. To do so, for example, a method of increasing the thickness of the insulation film and a method of using a resin having a low specific dielectric constant for the insulation film can be exemplified. Generally, partial-discharge start voltage in an insulated wire is proportional to the thickness of the insulation film and is inversely proportional to the specific dielectric constant of the insulation film.

A method of making the insulation film thick, however, has a problem in that because the thickness of the film formed by one coating and baking process is usually thin, approximately several microns, a number of repetitions of the process needs to be increased. Consequently, production cost will increase. On the other hand, if an insulation film is formed by simply using a fluoric polyimide resin to decrease the specific dielectric constant, there is a problem in that weak adhesion between the insulation film and a conductor tends to cause peeling, resulting in the occurrence of dielectric breakdown.

Accordingly, there have been proposed various methods of increasing the adhesion between the insulation film and the conductor as well as simultaneously making the specific dielectric constant of the insulation film low. For example, JP-B 4177295 has disclosed an inverter-surge-resistant insulated wire composed of a resin material, having at least one enamel-baked layer provided on the outer periphery of the conductor and at least one extrusion-coated resin (excluding polyether ether ketone) layer on the outer periphery thereof, wherein the total thickness of the enamel-baked layer and the extrusion-coated resin layer is 60 μm or more, the thickness of the enamel-baked layer is 50 μm or less, and the tensile elastic modulus of the extrusion-coated resin layer is 1000 MPa or more at 25° C. and 10 MPa or more at 250° C. According to JP-B 4177295, it seems to be possible to provide an insulated wire having a high partial-discharge start voltage (approximately 900 V) without decreasing the adhesion strength between the conductor and the insulation film.

JP-A 2008-288106 has disclosed an insulated wire in which an enamel layer of 50 μm thick or less is formed on a conductor by applying and baking resin varnish, an extrusion-coated resin layer extrusion-coated with a thermoplastic resin having a specific dielectric constant of 4.5 or less is formed on the enamel layer, and protrusions are provided on the outermost layer of the extrusion-coated resin layer. In the insulated wire described in JP-A 2008-288106, it seems to be possible to increase corona characteristics between the insulated wire and a motor's slot into which the insulated wire is inserted and/or between adjacent insulated wires wound, thereby making it possible to make the insulation film thin. Additionally, when the insulated wire is inserted into the motor's slot, it seems that the surface of the insulation film is not damaged easily.

As stated above, with the further advancement in higher efficiency and higher output in electrical equipment, there is a need for insulated wires to further increase the partial-discharge start voltage (e.g., 1500V or more). Herein, in a conventional insulated wire having an enamel layer and an extrusion-coated resin layer such as those described in JP-B 4177295 and JP-A 2008-288106, it seems to be possible to make the partial-discharge start voltage high by increasing the thickness of the extrusion-coated resin layer so as to increase the thickness of the insulation film.

However, since characteristics of the resin composition of the conventional enamel layer greatly differ from those of the resin composition of the extrusion-coated resin layer, adhesion between the layers tends to become inadequate, causing inter-layer peeling or wrinkling to occur on the insulation film in severe processing conditions (e.g., where the wire is wound into a small radius), and consequently, resulting in the decrease in the partial-discharge start voltage. To address this problem, in the conventional insulated wires that are preferred embodiments described in JP-B 4177295 and JP-A 2008-288106, an adhesion layer is interposed between the enamel layer and the extrusion-coated resin layer to enhance the adhesion therebetween. However, when interposing the adhesion layer between those layers, a problem arises in that the production cost further increases.

SUMMARY OF THE INVENTION

Under these circumstances, it is an objective of the present invention to solve the above problems and to provide an insulated wire having an insulation film composed of a plurality of layers provided on a conductor, in which adhesion between the conductor and the insulation film is excellent, adhesion between the layers of the insulation film is also excellent without interposing an additional layer such as an adhesion layer, and a high partial-discharge start voltage is provided.

(1) According to one aspect of the present invention, there is provided an insulated wire having an insulation film composed of a plurality of layers provided on a conductor, in which:

the insulation film includes a first film layer and a second film layer; the first film layer is made of a first resin composition formed by graft-polymerizing a graft compound with an ethylene-tetrafluoroethylene copolymer and is provided on a circumference of the conductor; and the second film layer is made of a second resin composition being a polymer alloy made of a polyphenylene sulfide resin and a polyamide resin and is provided on a circumference of the first film layer.

(2) According to another aspect of the present invention, there is provided an insulated wire having an insulation film composed of a plurality of layers provided on a conductor, in which:

the insulation film includes a first film layer and a second film layer; the first film layer is made of a first resin composition formed by graft-polymerizing a graft compound with an ethylene-tetrafluoroethylene copolymer and provided on a circumference of the conductor; and the second film layer is made of a second resin composition being a polymer alloy made of a polyether ether ketone resin and a polyamide resin and provided on a circumference of the first film layer.

In the above aspects (1) and (2) of the invention, the following modifications and changes can be made.

(i) The graft compound contains a peroxide group or an organic group having an α,β-unsaturated double bond at a terminal end thereof to be working as a graft-polymerization bonding group, and also contains at least one of a functional group providing adhesion selected from a carboxyl group, carboxylic acid anhydride residue, epoxy group, and hydrolyzable silyl group.

(ii) The storage elastic modulus of the second resin composition is 1 GPa or more at 20° C., and 10 MPa or more at 200° C.

(iii) A thickness of the first film layer is 30 μm or more but not thicker than 300 μm, and a thickness of the second film layer is 20 μm or more but not thicker than 300 μm.

ADVANTAGES OF THE INVENTION

According to the present invention, it is possible to provide an insulated wire having an insulating film composed of a plurality of layers provided on the conductor, in that adhesion between the conductor and the insulation film is excellent, adhesion between layers of the insulation film is also excellent without interposing an additional layer such as an adhesion layer, and a partial-discharge start voltage is high.

BRIEF DESCRIPTION OF THE DRAWINGS

FIG. 1 is a schematic illustration showing a cross-sectional view of an exemplary insulated wire of an embodiment according to the present invention.

DETAILED DESCRIPTION OF THE PREFERRED EMBODIMENTS

Hereafter, an embodiment of the present invention will be described in detail with reference to an accompanying drawing. However, the present invention is not intended to be limited to the specific embodiments described herein, but various combinations and modifications of its features can be made within the scope of the invention.

In order to achieve the aforementioned objectives, the inventors have studiously examined a resin composition (first resin composition) used for the first film layer (also called first covering layer) and a resin composition (second resin composition) used for the second film layer (also called second covering layer). Consequently, the inventors found that an adhesive ethylene-tetrafluoroethylene copolymer (hereafter, abbreviated as adhesive ETFE) formed by graft-polymerizing a graft compound with an ethylene-tetrafluoroethylene copolymer has a low specific dielectric constant and good adhesion to the conductor and the second covering layer, and is suitable for the first resin composition. The inventors also found that for the second covering layer, a polyphenylene sulfide (PPS) resin or a polyether ether ketone (PEEK) resin formed by alloying a polyamide resin is preferable. The present invention has been thus achieved based on the knowledge.

FIG. 1 is a schematic illustration showing a cross-sectional schematic diagram showing view of an exemplary insulated wire of an embodiment according to the present invention. As shown in FIG. 1, an insulated wire 10 according to the present invention has an insulation film 4 composed of a plurality of layers provided on the conductor 1. The insulation film 4 comprises a first film layer 2 made of a first resin composition formed on a circumference of the conductor 1 by graft-polymerizing a graft compound with an ethylene-tetrafluoroethylene copolymer (ETFE) and a second covering layer 3 made of a second resin composition of a PPS resin or a PEEK resin formed on a circumference of the first covering layer 2 by alloying a polyamide resin. This multi-layer insulation film structure makes it possible to increase the adhesion strength between the conductor 1 and the first covering layer 2 as well as increase the adhesion strength between the first covering layer 2 and the second covering layer 3. Accordingly, it is possible to increase the partial-discharge start voltage, wear resistance, and the heat resistance of the entire insulation film.

More specifically, the adhesive ETFE is formed by graft-polymerizing, with an ethylene-tetrafluoroethylene copolymer, a graft compound containing a peroxide group or an organic group having an α,β-unsaturated double bond at the terminal end thereof to be functioning as a graft-polymerization bonding group as well as containing at least one of the functional groups providing adhesion which can be selected from a carboxyl group, carboxylic acid anhydride residue, epoxy group, and hydrolyzable silyl group. Graft polymerization methods include, e.g., a method of reacting an ETFE with a graft compound in the presence of a radical generator.

The main purpose of the first covering layer 2 is to increase the partial-discharge start voltage, and it is preferable that the thickness be 30 μm or more but not thicker than 300 μm. If the first covering layer 2 is thinner than 30 μm, the effect of increasing the partial-discharge start voltage is inhibited, and if it is thicker than 300 μm, flexibility of the insulated wire decreases, resulting in a decrease in the ability to wind wire in the process of molding the coil. Furthermore, the reason why the adhesive ETFE so effectively adheres to the conductor seems to be that the graft-polymerized bonding group of the adhesive ETFE firmly binds with a surface of the conductor.

The second covering layer 3 formed on the circumference of the first covering layer 2 must have excellent resistance against damage (wear resistance) because it is subject to the processing stress caused by winding or friction in the winding process when molding the coil as well as have good heat resistance to withstand heat generated by a motor when it is used. To satisfy the requirements, it is preferable that the second covering layer 3 be formed by extrusion-coating a second resin composition having a storage elastic modulus of 1 GPa or more at 20° C., and 10 MPa or more at 200° C.

If the storage elastic modulus at 20° C. is smaller than 1 GPa, scratches or cracks may occur on the surface of the insulation film in the winding process when molding the coil, causing a problem in which the insulation capability decreases. If the storage elastic modulus at 200° C. is smaller than 10 MPa, when the insulation film is subject to stress due to compression during the use in the motor, there is a problem in that dielectric breakdown may occur.

In order to satisfy the requirements for the second covering layer 3, it is preferable that a resin composition formed by alloying a polyphenylene sulfide (PPS) resin with a polyamide resin, or a resin composition formed by alloying a polyether ether ketone (PEEK) resin with a polyamide resin be used for the second resin composition. Furthermore, the reason why the adhesive ETFE so effectively adheres to the PPS resin or the PEEK resin formed by alloying a polyamide resin seems to be that the graft-polymerized functional group of the adhesive ETFE firmly binds with the amide group of polyamide. Therefore, it is possible to increase the adhesion strength between the second covering layer 3 and the first covering layer 2 without interposing an additional layer such as an adhesion layer.

The second covering layer 3 is preferably as thin as possible within the range where the wear resistance and heat resistance properties are not inhibited, and the thickness is desirably 20 μm or more but not thicker than 300 μm. If the second covering layer 3 is thinner than 20 μm, microcracks (film breakage) may occur in the winding process when molding the coil, resulting in decreasing the insulation capability. If the second covering layer 3 is thicker than 300 μm, flexibility of the insulated wire decreases, resulting in decreasing the ability to wind wire in the process of molding the coil.

In the present invention, it is desirable that a polyamide resin used for alloying has a melting point of 150° C. or higher, and excellent mechanical strength. To take specific examples, the following can be exemplified: polycaproamide (polyamide 6), polyhexamethylene adipamide (polyamide 66), polypentamethylene adipamide (polyamide 56), polytetramethylene adipamide (polyamide 46), polyhexamethylene sebacamide (polyamide 610), polyhexamethylene dodecamide (polyamide 612), polyundecaneamide (polyamide 11), polydodecaneamide (polyamide 12), polycaproamide/polyhexamethylene adipamide copolymer (polyamide 6/66), polycaproamide/polyhexamethylene terephthalamide copolymer (polyamide 6/6T), polyhexamethylene adipamide/polyhexamethylene isophthalamide copolymer (polyamide 66/61), polyhexamethylene terephthalamide/polyhexamethylene isophthalamide copolymer (polyamide 6T/6I), polyhexamethylene terephthalamide/polydodecaneamide copolymer (polyamide 6T/12), polyhexamethylene adipamide/polyhexamethylene terephthalamide/polyhexamethylene isophthalamide copolymer (polyamide 66/6T/6I), polyxylylene adipamide (polyamide XD6), polyhexamethylene terephthalamide/poly-2-methylpentamethylene terephthalamide copolymer (polyamide 6T/M5T), and copolymers having a polymethylene terephthalamide unit.

There are no particular restrictions to a material of the conductor 1, and any material (e.g., oxygen-free copper, low-oxygen copper, or the like) commonly used for enamel-coated insulated wires can be used. Furthermore, a copper wire whose surface has been treated with an adhesion improving agent, such as a silane coupling agent, can be used as a conductor (in the present invention, conductors are to include conductors whose surface has been treated). By treating the wire surface with an adhesion improving agent, it is possible to further increase the adhesion strength between the conductor and the adhesive ETFE which is the first covering layer 2.

There are no particular restrictions to the silane coupling agent, and mercapto-based silane compounds, amino-based silane compounds, and azole-based silane compounds can be used, for example. Additionally, melanin-based compounds, carbodiimide-based compounds, tetrazole-based compounds, triazinethiol-based compounds, and aminothiazole-based compounds can also be used. Moreover, if the surface-treated layer using an adhesion improving agent is made thick, the boundary face tends to become fragile and rather decreases adhesion strength, therefore, it is preferable that the surface-treated layer be made thin.

EXAMPLE

Hereafter, the present invention will be described in more detail based on the examples, however, the present invention is not intended to be limited to those examples.

Preparation of Example 1

A copper wire having a diameter of 2 mm was used as a conductor, and a 100-μm thick first covering layer was formed on the circumference of the copper wire by means of extrusion-coating. For the resin composition of the first covering layer, an adhesive ETFE (LM-ETFE AH2000, melting point of 240° C., made by Asahi Glass Co., Ltd.) was used. For the resin composition of the second covering layer, an alloyed resin composition (hereafter, referred to as PPS-PA alloy) made by blending 10 mass % of 66 nylon (Zytel 42A made by E.I.du Pont de Nemours & Company Inc.) with a PPS resin (Torelina A900 made by Toray Industries, Inc.) was used. Next, a 20-μm thick second covering layer was formed on the circumference of the first covering layer by extrusion-coating the PPS-PA alloy, thus, an insulated wire according to Example 1 was prepared.

Preparation of Example 2

According to the same procedure as Example 1, a 100-μm thick adhesive ETFE was formed as a first covering layer on the circumference of a copper wire having a diameter of 2 mm. For the resin composition of the second covering layer, an alloyed resin composition (hereafter, referred to as PEEK-PA alloy) made by blending 10 mass % of 66 nylon (Zytel 42A made by E.I.du Pont de Nemours & Company Inc.) with a polyether ether ketone resin (PEEK 450G made by Victrex Manufacturing Limited) was used. Next, a 120-μm thick second covering layer was formed on the circumference of the first covering layer by extrusion-coating the PEEK-PA alloy, thus, an insulated wire according to Example 2 was prepared.

Preparation of Example 3

According to the same procedure as Example 1, a 30-μm thick adhesive ETFE was formed as a first covering layer on the circumference of a copper wire having a diameter of 2 mm. Next, a 120-μm thick second covering layer was formed on the circumference of the first covering layer by extrusion-coating the PPS-PA alloy, thus, an insulated wire according to Example 3 was prepared.

Preparation of Example 4

According to the same procedure as Example 1, a 300-μm thick adhesive ETFE was formed as a first covering layer on the circumference of a copper wire having a diameter of 2 mm. Next, a 300-μm thick second covering layer was formed on the circumference of the first covering layer by extrusion-coating the PPS-PA alloy, thus, an insulated wire according to Example 4 was prepared.

Preparation of Comparative Example 1

According to the same procedure as Example 1, a 100-μm thick first covering layer was formed on the circumference of a copper wire having a diameter of 2 mm. For the resin composition of the first covering layer, a tetrafluoroethylene-hexafluoropropylene copolymer (Neofron NP20 made by Daikin Industries, Ltd., hereafter, referred to as FEP) was used. Next, a 30-μm thick second covering layer was formed on the circumference of the first covering layer by extrusion-coating the PPS-PA alloy, thus, an insulated wire according to Comparative example 1 was prepared.

Preparation of Comparative Example 2

According to the same procedure as Example 1, a 130-μm thick adhesive ETFE was formed as a first covering layer on the circumference of a copper wire having a diameter of 2 mm, thus, an insulated wire with the first covering layer only (single layer) according to Comparative example 2 was prepared.

Preparation of Comparative Example 3

According to the same procedure as Example 1, a 100-μm thick adhesive ETFE was formed as a first covering layer on the circumference of a copper wire having a diameter of 2 mm. For the resin composition of the second covering layer, an alloyed resin composition (hereafter, referred to as FEP-PA alloy) made by blending 10 mass % of 66 nylon (Zytel 42A made by E.I.du Pont de Nemours & Company Inc.) with an FEP was used. Next, a 30-μm thick second covering layer was formed on the circumference of the first covering layer by extrusion-coating the FEP-PA alloy, thus, an insulated wire according to Comparative example 3 was prepared.

Preparation of Comparative Example 4

According to the same procedure as Example 1, a 100-1 μm thick first covering layer was formed on the circumference of a copper wire having a diameter of 2 mm. For a resin composition of the first covering layer, an ordinary ethylene-tetrafluoroethylene copolymer (C55AP, melting point of 260° C., made by Asahi Glass Co., Ltd., hereafter, referred to as ETFE) was used. Next, a 30-μm thick second covering layer was formed on the circumference of the first covering layer by extrusion-coating the PPS-PA alloy, thus, an insulated wire according to Comparative example 4 was prepared.

Preparation of Comparative Example 5

According to the same procedure as Example 1, a 100-μm thick ETFE was formed as a first covering layer on the circumference of a copper wire having a diameter of 2 mm. Next, a 30-μm thick second covering layer was formed on the circumference of the first covering layer by extrusion-coating a PPS resin, thus, an insulated wire according to Comparative example 5 was prepared.

Preparation of Comparative Example 6

According to the same procedure as Example 1, a 100-μm thick first covering layer was formed on the circumference of a copper wire having a diameter of 2 mm. For the resin composition of the first covering layer, a poly-4-methylpentene-1 resin (TPX RT-18 made by Mitsui Chemicals, Inc., hereafter referred to as PMP) was used. Next, a 30-μm thick second covering layer was formed on the circumference of the first covering layer by extrusion-coating the PPS-PA alloy, thus, an insulated wire according to Comparative example 6 was prepared.

The following measurements and tests were carried out for the above Examples 1 to 4 and Comparative examples 1 to 6.

(1) Measurement of Storage Elastic Modulus

The storage elastic modulus of the resin composition was measured as follows. By the use of each resin composition, a 0.1 mm (thickness)×5 mm×20 mm, strip-type evaluation film was separately prepared. The storage elastic modulus of the evaluation film was measured by a dynamic viscoelasticity measuring apparatus (DVA-200 made by IT Measurement Control Co., Ltd.) while applying 0.1% of tensile strain to the film and simultaneously increasing the temperature from room temperature to 400° C. at a rate of 5° C./rain.

(2) Measurement of Partial-Discharge Start Voltage

The partial-discharge start voltage was measured by the following procedure. An insulated wire was cut to two 500-mm long wires, and those two wires were twisted while applying a 14.7-N (1.5-kgf) tensile force, thereby making a twisted-pair wire sample having a 9-time twisting portion in the area of 120 mm at the central portion. The 10-mm long insulation coating on one end of the wire sample was peeled off by an abisofix apparatus. Subsequently, to dry the insulation coating, the wire sample was kept in the 120° C. constant-temperature bath for 30 minutes and left in a desiccator for 18 hours until reaching room temperature. Partial-discharge start voltage was measured by a partial-discharge automatic test system (DAC-6024 made by Soken Electric Co., Ltd.). Under the measurement condition of a 25° C.-atmosphere with relative humidity of 50%, while a 1-kHz sine-wave voltage was increased at a rate of 10 to 30 V/s, the twisted-pair wire sample was electrically charged. The voltage at which a 10-pC electric discharge occurred to the twisted-pair wire sample 50 times was specified as a partial-discharge start voltage.

(3) Wear Resistance Test

The wear resistance test was conducted by the following procedure. First, an insulated wire was cut to a length of 120 mm, and the insulation coating on one wire terminal was peeled off by an abisofix apparatus, preparing an evaluation specimen. After the evaluation sample was attached to the Taber-type wear test machine (TS-4 made by Toei Industry Co., Ltd.), an electrode was connected to the peeled terminal portion of the evaluation specimen. Then, while a load of 5.9 N (0.6 kgf) was perpendicularly applied to a surface of the insulation film, reciprocation wear test of the sensing pin (with a reciprocation amplitude of 20 mm) was conducted. When an electric current began to flow between the conductor of the evaluation specimen and the sensing pin, the number of reciprocations was measured.

(4) Adhesion Test

The adhesion test was conducted by the following procedure. Each insulated wire was wound onto a rod (winding rod) having a diameter equivalent to the conductor diameter (self-diameter winding), and inspections for abnormalities (e.g., cracks, flaws, wrinkles, peeling) on the insulation film were executed by the use of an optical microscope. In the present invention, when an insulated wire was wound five times per coil, the 5-coil worth length of insulated wire was wound and inspected by an optical microscope at a magnification of 50.

(5) Heat Resistance Test

The heat resistance test was conducted by the following procedure. In the same manner as the above adhesion test, after the self-diameter winding was performed, heating at 200° C. for one hour was conducted using an aging test machine (gear oven STD60P made by Toyo Seiki Co., Ltd.). Subsequently, inspections for abnormalities (e.g., cracks, flaws, wrinkles, peeling) on the insulation film were executed by the use of an optical microscope.

Measurement results of the storage elastic modulus of the resin compositions were as described below. As for an adhesive ETFE, the storage elastic modulus was 0.77 GPa at 20° C. and 30 MPa at 200° C. As for an ordinary ETFE, the storage elastic modulus was 0.80 GPa at 20° C. and 40 MPa at 200° C. As for an FEP, the storage elastic modulus was 0.57 GPa at 20° C. and 30 MPa at 200° C. As for a PMP, the storage elastic modulus was 1.6 GPa at 20° C. and 60 MPa at 200° C. As for a PPS-PA alloy, the storage elastic modulus was 3.0 GPa at 20° C. and 500 MPa at 200° C. As for a PEEK-PA alloy, the storage elastic modulus was 3.5 GPa at 20° C. and 500 MPa at 200° C. As for an FEP-PA alloy, the storage elastic modulus was 0.60 GPa at 20° C. and 31 MPa at 200° C. And, as for a PPS, the storage elastic modulus was 3.37 GPa at 20° C. and 356 MPa at 200° C.

Table 1 shows the specifications and measurement test results of Examples 1 to 4, and Table 2 shows the specifications and measurement test results of Comparative examples 1 to 6.

TABLE 1

Specifications and measurement test results of Examples 1 to 4.

| | Example 1 | Example 2 | Example 3 | Example 4 |
|---|---|---|---|---|
| First covering layer | Adhesive ETFE 100 μm | Adhesive ETFE 100 μm | Adhesive ETFE 30 μm | Adhesive ETFE 300 μm |
| Second covering layer | PPS-PA alloy 20 μm | PEEK-PA alloy 120 μm | PPS-PA alloy 120 μm | PPS-PA alloy 300 μm |
| Partial-discharge start voltage | 2500 V or more | 2500 V or more | 1500 V | 2500 V or more |
| Wear resistance test | 2000 times or more | 2000 times or more | 2000 times or more | 2000 times or more |
| Adhesion test | No abnormality | No abnormality | No abnormality | No abnormality |
| Heat resistance test | No abnormality | No abnormality | No abnormality | No abnormality |

As shown in Tables 1 and 2, it was verified that the insulated wires of Examples 1 to 4 according to the present invention have good wear resistance, adhesion strength, and heat resistance when compared with the insulated wires of Comparative examples 1 to 6 which depart from the prescribed scope of the present invention. On the other hand, sufficiently high properties (1500 V or more) were obtained with respect to the partial-discharge start voltage. Consequently, it was experimentally proven that the insulated wires according to the present invention have excellent adhesion between the conductor and the insulation film as well as excellent adhesion between layers of the insulation film without interposing an additional layer such as an adhesion layer, and also have a high partial-discharge start voltage.

Although the present invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated wire to be used for a coil for electrical equipment controlled by an inverter having an insulation film composed of a plurality of layers provided on a conductor, wherein:

the plurality of layers comprises a first film layer and a second film layer;

the first film layer is made of a first resin composition formed by graft-polymerizing a graft compound with an ethylene-tetrafluoroethylene copolymer and is provided on a circumference of the conductor;

the second film layer is made of a second resin composition being a polymer alloy made of a polyether ether ketone resin and a polyamide resin and is provided on a circumference of the first film layer;

the storage elastic modulus of the second resin composition is 1 GPa or more at 20° C., and 10 MPa or more at 200° C.;

TABLE 2

Specifications and measurement test results of Comparative examples 1 to 6.

| | Comparative example 1 | Comparative example 2 | Comparative example 3 | Comparative example 4 | Comparative example 5 | Comparative example 6 |
|---|---|---|---|---|---|---|
| First covering layer | FEP 100 μm | Adhesive ETFE 130 μm | Adhesive ETFE 100 μm | ETFE 100 μm | ETFE 100 μm | PMP 100 μm |
| Second covering layer | PPS-PA alloy 30 μm | None | FEP-PA alloy 30 μm | PPS-PA alloy 30 μm | PPS 30 μm | PPS-PA alloy 30 μm |
| Partial-discharge start voltage | 2500 V or more | 2500 V or more | 2500 V or more | 2500 V or more | 2500 V or more | 2300 V |
| Wear resistance test | 2000 times or more | 30 times | 20 times | 2000 times or more | 2000 times or more | 2000 times or more |
| Adhesion test | Occurrence of wrinkles | No abnormality | Occurrence of wrinkles | Occurrence of wrinkles | Occurrence of wrinkles | No abnormality |
| Heat resistance test | Occurrence of wrinkles | Occurrence of uneven thickness in first covering layer | Occurrence of uneven thickness in first covering layer | Occurrence of wrinkles | Occurrence of wrinkles Occurrence of cracks | Occurrence of wrinkles Occurrence of uneven thickness in first covering layer |

the insulated wire has a partial-discharge start voltage of 1500 V or more and is configured to be used for a coil for electrical equipment controlled by an inverter; and the insulated wire has an adhesion property that, when a five-coil worth length of insulated wire is wound onto a winding rod having a diameter equivalent to a diameter of the conductor, and inspected for abnormalities selected from the group consisting of cracks, flaws, wrinkles and peeling an optical microscope at a magnification of 50, the insulation film does not exhibit any of said abnormalities.

2. The insulated wire according to claim 1, wherein:

the graft compound contains a peroxide group or an organic group having an α,β-unsaturated double bond at the terminal end thereof to be working as a graft-polymerization bonding group, and also contains at least one of the functional groups providing adhesion selected from a carboxyl group, carboxylic acid anhydride residue, epoxy group, and hydrolyzable silyl group.

3. The insulated wire according to claim 1, wherein:

a thickness of the first film layer is 30 μm or more but not thicker than 300 μm; and a thickness of the second film layer is 20 μm or more but not thicker than 300 μm.

4. The insulated wire according to claim 1, wherein the insulated wire has a wear resistance property such that a number of reciprocations of a sensing pin perpendicularly applied to a surface of the insulation film under a load of 5.9 N until an electric current begins to flow between the sensing pin and an electrode connected to the conductor is more that 2000.

5. An insulated wire to be used for a coil for electrical equipment controlled by an inverter having an insulation film composed of a plurality of layers provided on a conductor, wherein:

the insulation film comprises a first film layer and a second film layer;

the first film layer is made of a first resin composition formed by graft-polymerizing a graft compound with an ethylene-tetrafluoroethylene copolymer and is provided on a circumference of the conductor;

the second film layer is made of a second resin composition being a polymer alloy made of a polyphenylene sulfide resin and a polyamide resin and is provided on a circumference of the first film layer;

the storage elastic modulus of the second resin composition is 1 GPa or more at 20° C., and 10 MPa or more at 200° C.;

the insulated wire has a partial-discharge start voltage of 1500 V or more and is configured to be used for a coil for electrical equipment controlled by an inverter; and the insulated wire has an adhesion property that, when a five-coil worth length of insulated wire is wound onto a winding rod having a diameter equivalent to a diameter of the conductor, and inspected for abnormalities selected from the group consisting of cracks, flaws, wrinkles and peeling an optical microscope at a magnification of 50, the insulation film does not exhibit any of said abnormalities.

6. The insulated wire according to claim 5, wherein:

the graft compound contains a peroxide group or an organic group having an α,β-unsaturated double bond at a terminal end thereof to be working as a graft-polymerization bonding group, and also contains at least one of the functional groups providing adhesion selected from a carboxyl group, carboxylic acid anhydride residue, epoxy group, and hydrolyzable silyl group.

7. The insulated wire according to claim 5, wherein:

a thickness of the first film layer is 30 μm or more but not thicker than 300 μm; and a thickness of the second film layer is 20 μm or more but not thicker than 300 μm.

8. The insulated wire according to claim 5, wherein the insulated wire has a wear resistance property such that a number of reciprocations of a sensing pin perpendicularly applied to a surface of the insulation film under a load of 5.9 N until an electric current begins to flow between the sensing pin and an electrode connected to the conductor is more that 2000.

* * * * *